US006776320B2

(12) United States Patent
Sprenger et al.

(10) Patent No.: US 6,776,320 B2
(45) Date of Patent: Aug. 17, 2004

(54) SETTING TOOL

(75) Inventors: Markus Sprenger, Mauren (LI); Gebhard Gantner, Nenzing (AT)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/723,156

(22) Filed: Nov. 24, 2003

(65) Prior Publication Data

US 2004/0104259 A1 Jun. 3, 2004

(30) Foreign Application Priority Data

Nov. 26, 2002 (DE) ..... 102 54 964

(51) Int. Cl.[7] ..... B25C 1/14
(52) U.S. Cl. ..... 227/10
(58) Field of Search ..... 227/10, 9, 130, 227/156; 173/20

(56) References Cited

U.S. PATENT DOCUMENTS 3,338,141 A * 8/1967 Ramsay ..... 92/30
4,134,527 A * 1/1979 Termet ..... 227/10
4,867,365 A * 9/1989 Buechel et al. ..... 227/10
4,941,391 A * 7/1990 Ehmig et al. ..... 89/1.14
5,538,172 A * 7/1996 Jochum et al. ..... 227/10
5,881,940 A * 3/1999 Almeras et al. ..... 227/10
6,092,710 A * 7/2000 Kersten ..... 227/10
6,123,243 A * 9/2000 Pfister et al. ..... 227/10
6,431,426 B1 * 8/2002 Ehmig ..... 227/10
6,481,609 B2 * 11/2002 Dittrich et al. ..... 227/10
6,502,736 B2 * 1/2003 Dittrich et al. ..... 227/10

* cited by examiner

*Primary Examiner*—Scott A. Smith
(74) *Attorney, Agent, or Firm*—Sidley Austin Brown & Wood, LLP

(57) ABSTRACT

A setting tool includes a piston guide (13) displaceably arranged in the tool housing (11) and in a hollow chamber (14) of which a piston guide (13) is displaceable under action of a propellant from an initial position thereof to an end position thereof, a device (20) for breaking displacement of the setting piston (15) in its end position at an end of a setting process, and a wear recognition device (30) associated with the setting piston braking device (20) for automatically blocking a setting process dependent on a wear condition of the setting piston braking device.

10 Claims, 3 Drawing Sheets

SETTING TOOL

BACKGROUND OF THE INVENTION

1. Field of the Invention

The present invention relates to a setting tool including a housing, a piston guide displaceably arranged in the housing, a setting piston displaceable in a hollow chamber of the piston guide under action of a propellant from its initial position to its end position, and a device for braking displacement of the setting piston in its end position at an end of a setting process.

2. Description of the Prior Art

Setting tools of the type described above can be operated with solid, gaseous, or fluid fuels and can also be operated with compressed air. In combustion-engined setting tools, the piston is driven by combustion gases. The piston drives fastening elements in a constructional component.

German Publication DE-3930592A1 discloses a setting tool having a housing, a piston guide axially displaceable in the housing, and a setting piston displaceable in the piston guide. For effecting a setting process, the setting tool is pressed against a constructional component, whereby the piston guide is pressed into the interior of the housing. In order to reduce the piston energy at a faulty setting process or to reduce the excessive energy of the piston, there is provided, in the front region of the piston guide adjacent to the bolt guide, a braking device for catching the setting piston up. The braking device, e.g., an annular body formed of an elastomeric material is formed as a wear-out part.

The braking device can be also formed as a combination of an elastomeric ring and a metal ring.

The drawback of the known braking devices for the setting tools consists in that when the wear of the braking device or of the elastomeric ring is substantial and is not recognized, important and expensive parts of the setting tool can be damaged.

Accordingly, an object of the present invention is to provide a setting tool of the type described above in which the above-mentioned drawback is eliminated and damage of the setting tool components is prevented.

SUMMARY OF THE INVENTION

This and other objects of the present invention, which will become apparent hereinafter, are achieved by providing a setting tool of the type discussed above and in which there is provided a wear recognition device associated with the setting piston braking device for automatically blocking a setting process dependent on a wear condition of the setting piston braking device.

The blocking is effected with a mechanical blocking element that prevents pressing of the tool against a constructional component, making a tool user aware of that either a component of the setting piston braking device has not been mounted or that the braking device or one of its component has undergone an excessive wear. The use of a wear recognition device according to the present invention prevents damage of important components of the setting tools when the setting piston braking device or its components underwent wear in excess of the predetermined amount or the braking device or some of its component failed.

According to an advantageous embodiment of the present invention, the wear recognition device includes wear detection element(s) for detecting wear of the piston braking device, and a locking element for blocking a setting process in case of excessive wear of the braking device. There can be provided several wear detection elements, with each wear detection element cooperating with a separate locking element.

According to a further advantageous embodiment of the present invention, the piston guide is displaceable relative to the housing between an operational position in which a setting process can take place, and initial position corresponding to an initial position of the setting tool.

The piston guide can be supported against the housing by a spring. Upon detection of a certain wear amount or a wear condition, the locking element can be displaced by the wear detection means to its blocking position in which the setting tool cannot be displaced any more from its initial position into its setting position or the piston guide cannot be displaced into the interior of the housing. Thereby, the actuation of the setting tool is not any more possible when the braking device has reached a predetermined wear condition.

A compact construction is obtained when the wear recognition device is formed as an integral part of the braking device. Advantageously, the braking device includes a damping element, which can be formed as an elastic annular body, and a braking member which can be formed, e.g., as a non-elastic ring of metal. In an ideal case, the damping element and the braking element are so arranged at the end of the piston guide that the setting piston runs on the braking member, whereby the braking member, which is set back, is damped by the damping element. Thus, the wear of the braking device concentrates, primarily, in the damping element.

A simple connection of the wear recognition device with the braking device is effected when the wear detection means is provided on the braking member, and the locking element has an adjusting section that engages the wear detection means, whereby an operational connection is provided between the wear detection means and the locking element.

By providing, e.g., a spring for biasing the locking element to its blocking position, the locking element can always reliably be displaced into its locking position when the wear recognition device detects a certain wear condition or a failure, e.g., of the damping element.

Advantageously, the transmission of wear information between the wear detection means and the adjusting section of the locking-element is effected by an inclined surface which is provided on the wear detection means and which cooperates with an inclined surface provided on the adjusting section. Due to the cooperation of the inclined surfaces of the wear detection means and the locking member, the axial displacement of the wear detection means, which takes place as a result of, e.g., reduced width of the damping element caused by its wear, is converted into the radial displacement of the locking member that is displaced radially outwardly and becomes positioned between the piston guide and the housing.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
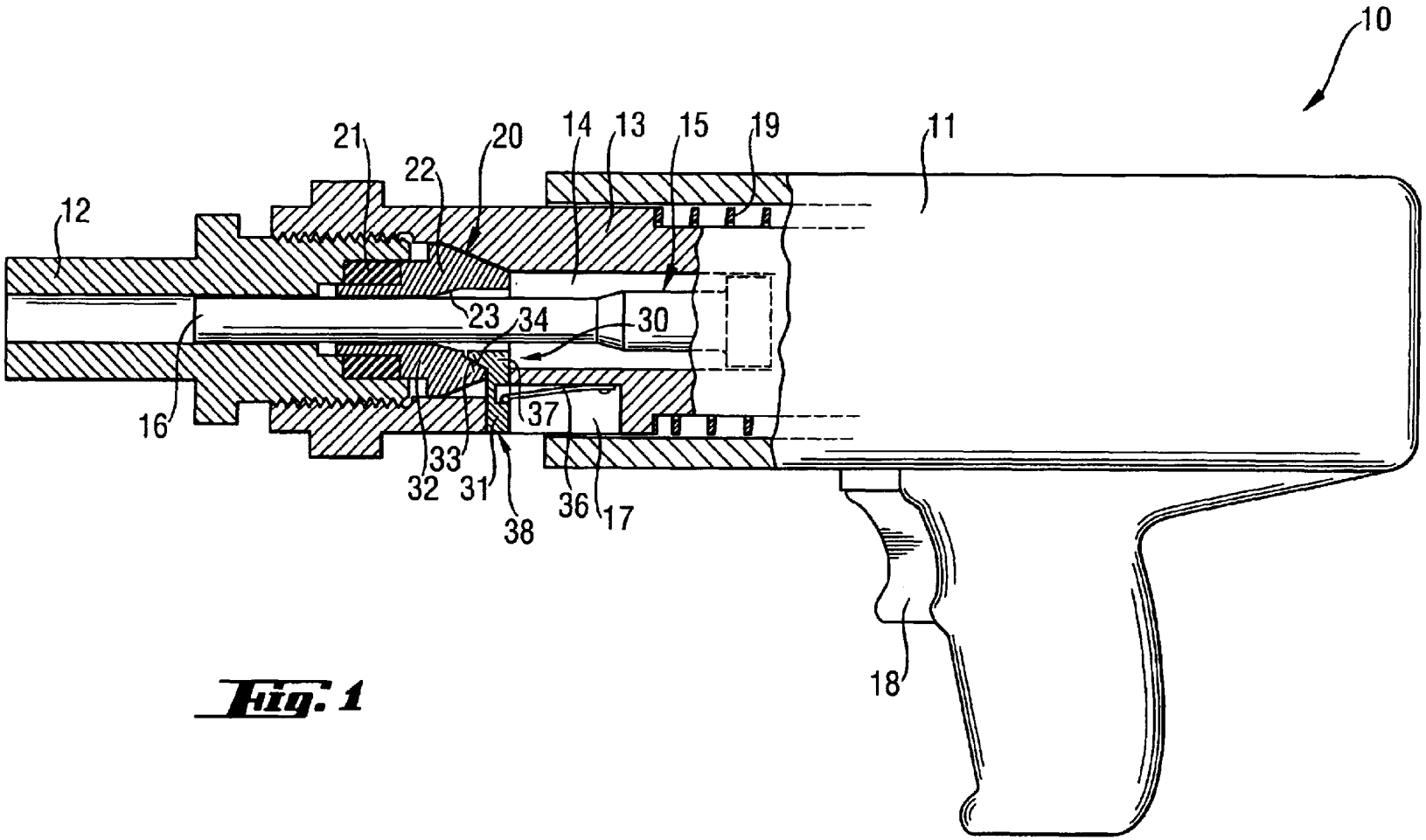
FIG. 1 a partially cross-sectional view of a setting tool according to the present invention.
Figure 2:
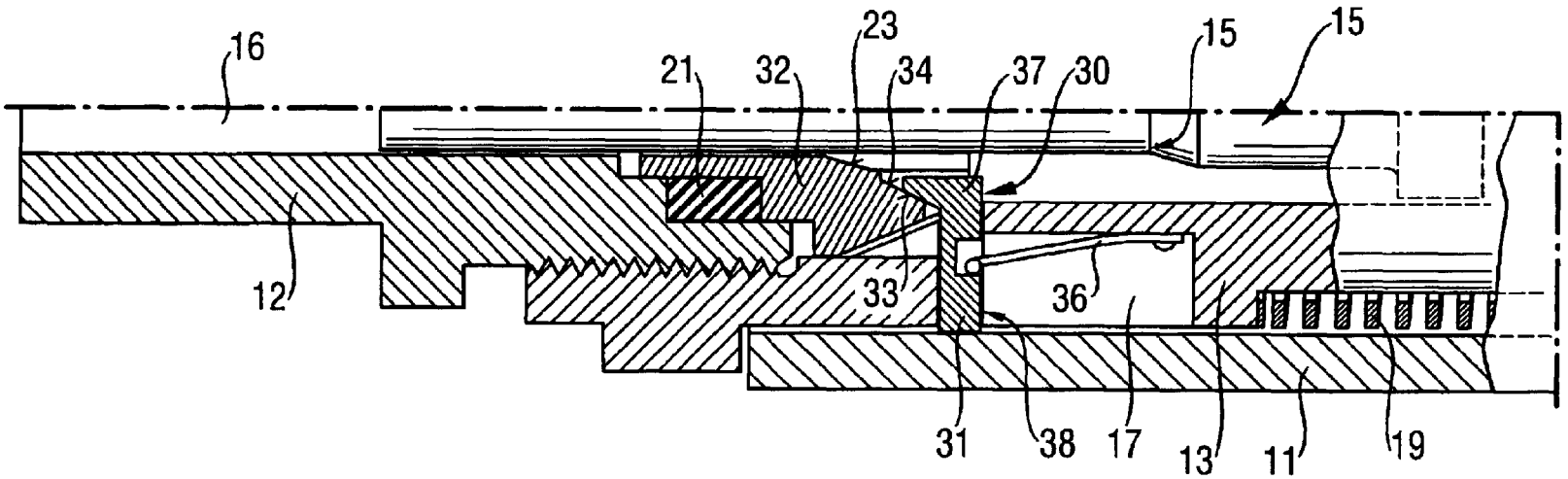
FIG. 2 a longitudinal cross-sectional view of a portion of the setting tool shown in FIG. 1 in a press-on condition of the tool, with the braking device having no wear.

A setting tool 10 according to the present invention, which is shown in FIGS. 1–2, is shown in a condition in which it braking device does not have any wear. The setting tool 10 has a one-or multi-part housing 11 and a piston guide 13 arranged in the housing 11. A setting piston 15 is displaceabley arranged in the hollow chamber 14 of the piston guide 13. The piston 15 is driven by a propellant or its reaction product such as e.g., combustion gases the guide 13 is displaceably arranged in the housing 11, which has a shape of a sleeve, and is supported against the housing 11 by a spring 19, e.g., a compression spring. As shown in FIG. 1, the spring 19 biases the piston guide 13, out of the housing 11 against a stop provided on the housing 11 when the setting took 10 is not pressed against a construction a component. The setting process can only then be effected when the setting tool 10 is pressed with its bolt guide 12, which is located in front of the piston guide 13, against a constructional component. For initiating a setting process, an actuation switch 18 is provided on the setting tool 10.

At an end of the piston guide 13 adjacent to the bolt guide 12, there is provided a piston braking device 20. The braking device 20 has, in the embodiment shown in the drawings, a damping element 21 formed as an elastomeric ring, and a braking member 22 formed as a metal sleeve and supported against the damping element 21. At an end surface of the braking member 22 remote from the bolt guide 12, there is provided a stop surface 23 with which the braking device 20 brakes the setting piston 15 when the setting piston 15 impacts the stop surface 23 during its forward movement.

On the piston braking device 20, there is further provided a wear-recognition device 30. The wear-recognition device 30 has a locking element 31 and wear detection means 32 provided on the braking member 22. The wear detection means 32 has an inclined surface 34 adjacent to the piston rod 16 of the setting piston 15 and which is engaged by an inclined surface 33 provided on an adjusting section 37 of the locking element 31. In FIGS. 1–2, the locking element 31 is shown in its release position 38 that the locking element 31 occupies when the damping element 21 has not attained its maximum allowable wear. A spring 36 is provided in a recess 17 formed in the piston guide 13. The spring 36 has one of its end secured to the piston guide 13 and the other of its end engaging the locking element 31, biasing the locking element 31 to its locking or braking position 35 (see FIG. 3).

Figure 3:
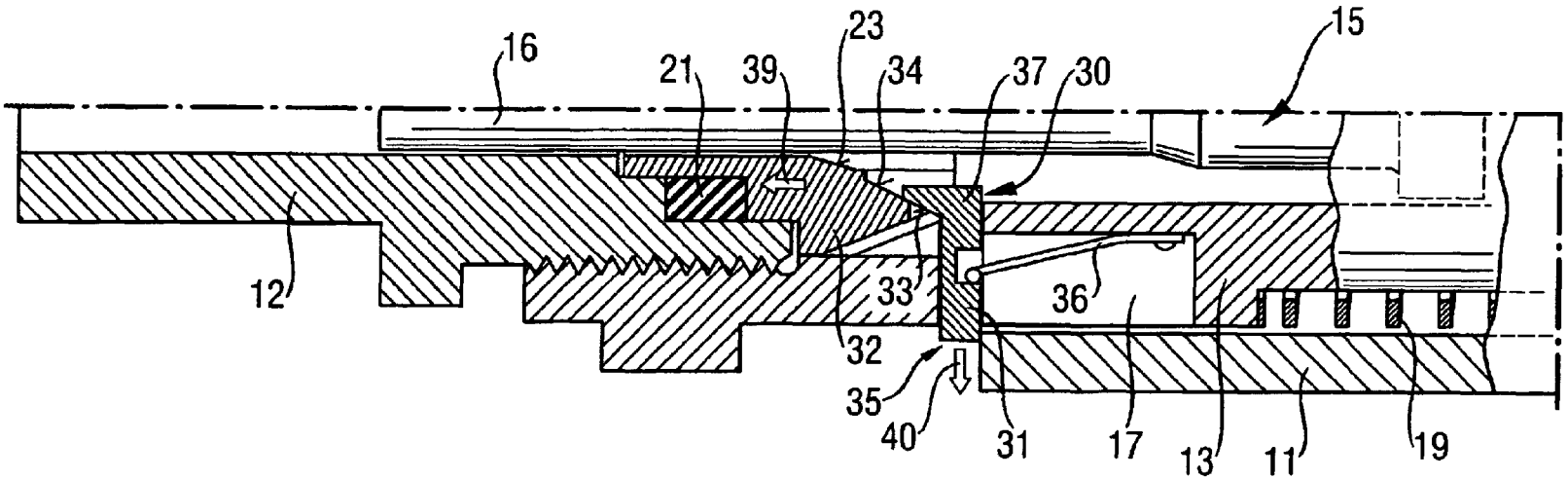
FIG. 3 a longitudinal cross-sectional view similar to that of FIG. 2 but with the braking device having a wear amount exceeding the maximum allowable wear.

FIG. 3 shows a section of the setting tool 10 in a condition when the damping element 21 reached its maximum allowable wear threshold. The wear reduces the width of the damping element 21, resulting in displacement of the wear detection means 32 with its inclined surface 34 in the setting direction 39. With the locking element 31 not being movable in the axial direction, the sliding movement of the inclined surface 34 of the wear detection means 32 relative to the inclined surface 33 of the locking element 31 during the movement of the wear detection means 32 in the direction 39 causes a radial displacement of the locking element 31 downward in direction 40. The radial movement of the locking element 31 leads to its displacement in the direction 40 from its release position 38 (FIG. 2) to its locking position 35 (FIG. 3). In the locking position 35 of the locking element 31, a complete pressing of the setting tool against a constructional component is not possible because the locking element 31 prevents displacement of the piston guide 13 into the interior of the housing 11. In this way, the tool user becomes aware of the excessive wear of the braking device or of an absence of the braking device.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A setting tool, comprising a housing (11); a piston guide (13) displaceably arranged in the housing (11), a setting piston (15) displaceable in a hollow chamber (14) of the piston guide (13) under action of a propellant from an initial position thereof to an end position thereof; a device (20) for braking displacement of the setting piston (15) in the end position thereof at an end of a setting process; and a wear recognition device (30) associated with the setting piston braking device (20) for automatically blocking a setting process dependent on a wear condition of the setting piston braking device.

2. A setting tool according to t claim 1, wherein the wear recognition device (30) comprises wear detection means (32) for detecting wear of the setting piston braking device (20), and a locking element (31) for blocking a setting process in case of excessive wear of the braking device.

3. A setting tool according to claim 2, wherein the wear detection means (32) has several wear detection elements, with each wear detection element cooperating with a separate locking element.

4. A setting tool according to claim 2, wherein the piston guide (13) is displaceable relative to the housing (11) between an operational position in which a setting process can take place, and an initial position corresponding to an initial position of the setting tool (10), and wherein the locking element (31) is displaced by wear detection means (32), at a predetermined amount of wear of the braking device (20) from a release position (38) thereof into a blocking position (35) thereof in which the locking element (31) prevents displacement of the piston guide (13) from the initial position thereof to the operational position thereof.

5. A setting tool according to claim 4, wherein the wear detection means (32) has an inclined surface (34) that cooperates with an inclined surface (33) of an adjusting section (37) of the locking element (31) for displacing the locking element (31) in radial direction upon displacement of the detection means in an axial direction.

6. A setting tool according to claim 2, wherein the braking device (20) has a damping element (21) and a braking member (22) for effecting a braking decelleration of the setting piston (15).

7. A setting tool according to claim 6, wherein the wear detection means (32) is arranged on the braking element (22), and wherein the locking element (31) has an adjusting section (37) operationally associated with the wear detection means (32).

8. A setting tool according to claim 2, further comprising spring means (36) for biasing the locking element (31) to its blocking position (35) in which it blocks the setting process.

9. A setting tool according to claim 2, wherein the locking element (31) blocks, in a blocking position (35) thereof displacement of the setting piston guide (13) relative to the housing (11).

10. A setting tool according to claim 1, wherein the wear recognition device (30) forms an integral component of the breaking device (20).

* * * * *